US005615866A

United States Patent [19]

Kinnison

[11] Patent Number: 5,615,866

[45] Date of Patent: Apr. 1, 1997

[54] VEGETATION BARRIER FOR FENCING

[76] Inventor: Robert W. Kinnison, P.O. Box 168, Fort Collins, Colo. 80522-0168

[21] Appl. No.: 564,453

[22] Filed: Nov. 29, 1995

[51] Int. Cl.[6] ..... E04H 17/06

[52] U.S. Cl. ..... 256/1; 256/32

[58] Field of Search ..... 256/1, 32, 19, 256/45, 34, 33, 35; 47/33

[56] References Cited

U.S. PATENT DOCUMENTS

| | | | |
|---|---|---|---|
| 3,713,624 | 1/1973 | Niemann | 256/32 |
| 3,768,780 | 10/1973 | Cowles et al. | 256/1 |
| 3,806,096 | 4/1974 | Eccleston et al. | 256/32 |
| 3,822,864 | 7/1974 | Keys | 256/32 |
| 3,991,980 | 11/1976 | Blackburn | 256/32 X |
| 4,497,472 | 2/1985 | Johnson | 256/32 |
| 4,515,349 | 5/1985 | Groves | 256/1 |
| 4,548,388 | 10/1985 | Cobler | 256/1 X |
| 4,903,947 | 2/1990 | Groves | 256/1 X |
| 4,907,783 | 3/1990 | Fisk et al. | 256/32 |
| 4,964,619 | 10/1990 | Glidden, Jr. | 256/32 |
| 5,039,065 | 8/1991 | Denton | 256/1 |
| 5,178,369 | 1/1993 | Syx | 256/32 |

*Primary Examiner*—Kenneth J. Dorner
*Assistant Examiner*—Harry C. Kim
*Attorney, Agent, or Firm*—Norman B. Rainer

[57] ABSTRACT

A vegetation barrier device for use in association with the lowermost extremity of a fence is constructed of a first member having an L-shaped extruded configuration and a second member in the form of an elongated flat strip. The two members are assembled upon the fence by bolts which penetrate the fence and both members to form a U-shaped structure defining an interior region capable of releasibly holding a water-leachable insecticidal agent.

2 Claims, 1 Drawing Sheet

VEGETATION BARRIER FOR FENCING

BACKGROUND OF THE INVENTION

1. Field of the Invention

The present invention relates to fence guards,and more particularly pertains to a vegetation barrier which may be positioned along the bottom edge of a fence.

2. Description of the Prior Art

The concept of providing the lower edge of a chain link fence with a so-called fence liner or fence guard which will serve as a vegetation barrier that inhibits or prevents the growth of grass to the base of the fence is generally known. Various devices have been proposed in the past to accomplish the above. The prior art devices usually involve a flat horizontal surface that spreads out on both sides of the bottom of the fence and thus physically prevents the growth of vegetation at the fence. Such devices are usually difficult to install, particularly when approaching or going around a fence post or the like. Also, frequently such devices are expensive and labor intensive during installation.

It is also generally known that the use of the modern line trimmer, wherein a spinning nylon or plastic line is used as the cutting blade, along the bottom edge of a chain link fence tends to cut and break the twirling line resulting in excess consumption of line. Yet, a well manicured lawn with the grass trimmed up to the bottom edge of the chain link fence and no growth within the weave of the fence is frequently considered to be the most aesthetically pleasing option. As such, the need still exists for a fence liner or guard that is inexpensive and readily compatible with a conventional chain link fence and that allows for the grass to grow right up to the fence bottom yet also allows for convenient trimming with a line trimmer.

U.S. Pat. Nos. 3,806,096; 3,822,864 and 4,497,472 disclose vegetation barriers of relatively complex design and do not provide a smooth contact surface for the rotating line of a trimmer.

U.S. Pat. Nos. 4,907,783 and 5,178,369 disclose fence edging attachments comprised of an extended form having a U-shaped configuration. Installation of an attachment of such configuration is difficult. Also, accumulated water can lead to freezing damage.

It is accordingly an object of the present invention to provide a vegetation barrier for a chain link fence, said barrier being amenable to easy installation.

It is another object of this invention to provide a vegetation barrier as in the foregoing object which is resistant to damage as a result of freezing of accumulated water.

It is a further object of the present invention to provide a barrier of the aforesaid nature capable of retaining an insecticidal composition.

It is a still further object of this invention to provide a barrier of the aforesaid nature of simple construction amenable to low cost manufacture from recycled plastic materials.

These objects and other objects and advantages of the invention will be apparent from the following description.

SUMMARY OF THE INVENTION

The above and other beneficial objects and advantages are accomplished in accordance with the present invention by a vegetation barrier adapted to engage the bottom edge of chain link fencing, said barrier comprising:

a) a first member in the form of an extruded L-shaped form of uniform cross-sectional configuration and comprised of an upright sidewall portion elongated along the axis of extrusion and bounded by a straight upper edge and a linear lower extremity that joins in a right angle corner configuration a flat floor panel portion intended to be horizontally disposed, said floor panel portion terminating in a straight distal edge which is parallel to said upper edge, said sidewall portion being provided with axially spaced installation apertures and having a height, defined by the orthogonally measured distance between said upper edge and lower extremity, which is greater than the width of said floor panel portion, measured between said linear lower extremity and distal edge, and b) a second edge member in the form of an elongated strip of uniform cross-sectional configuration bounded by opposed flat wall surfaces and opposed straight terminal edge surfaces, said strip having installation apertures spaced apart to align with the apertures of said first member, and having a width, measured orthogonally between said terminal edge surfaces which is equal to the height of the sidewall of said first member.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
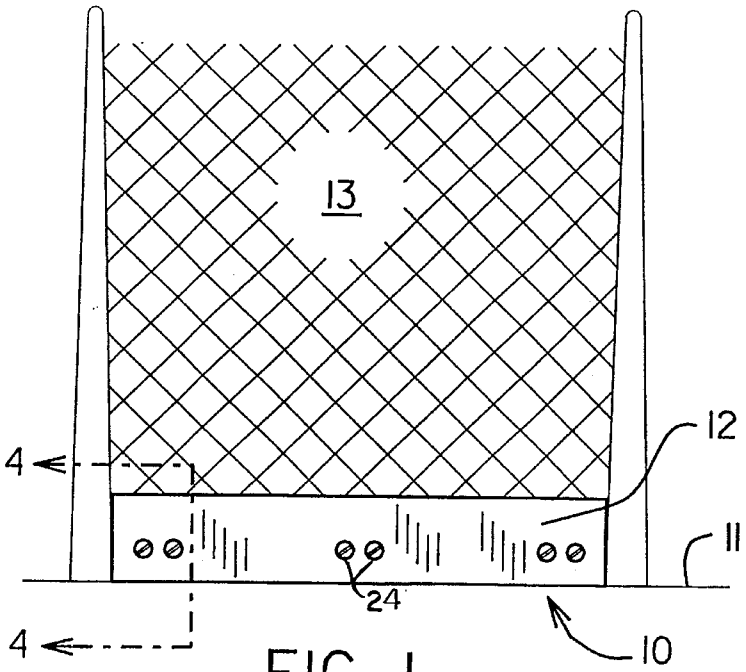
FIG. 1 is a side view of an embodiment of the barrier of the present invention shown in operative association with a chain link fence.
Figure 2:
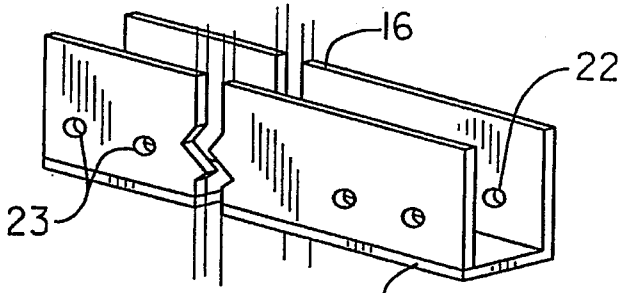
FIG. 2 is a perspective view of the barrier embodiment of FIG. 1.
Figure 3:
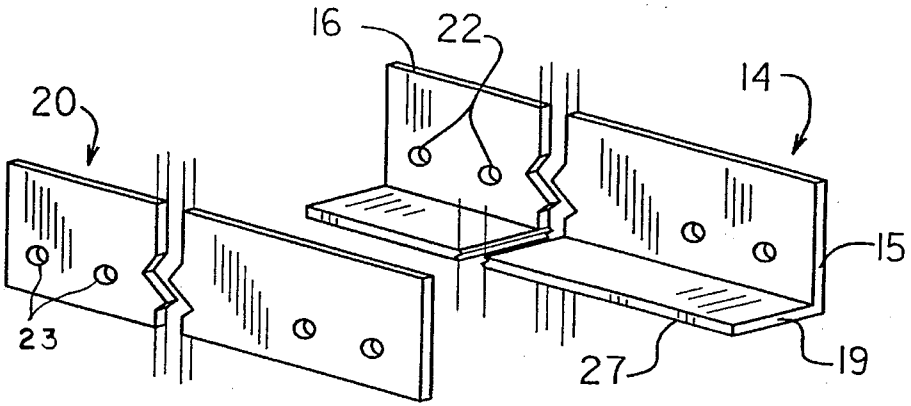
FIG. 3 is an exploded perspective view of the barrier of FIG. 2.
Figure 4:
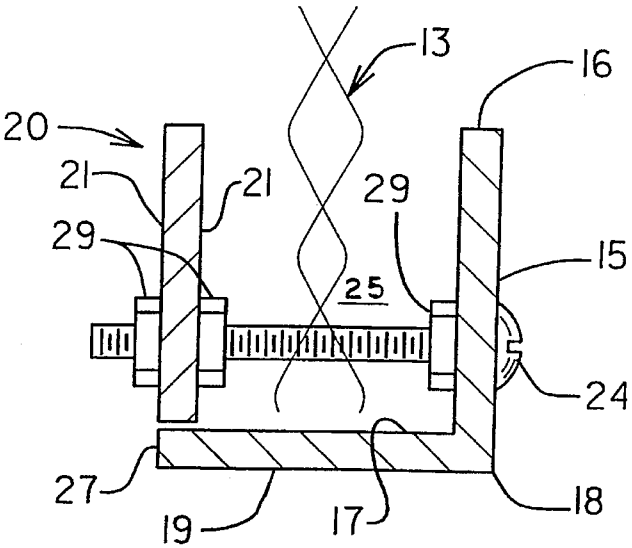
FIG. 4 is an enlarged sectional view taken in the direction of the arrows upon the line 4—4 of FIG. 1.

Referring now to FIGS. 1–4, an embodiment of the barrier device 10 of the present invention is shown emplaced upon the ground 11 in embracing association with the lower extremity 12 of chain link fence 13.

Barrier device 10 is comprised of first and second members, 14 and 20, respectively. First member 14 has the shape of an L-shaped extrudate of uniform cross-sectional configuration comprised of upright sidewall portion 15 elongated along the axis of extrusion and bounded by a straight upper edge 16 and a linear lower extremity 17 that forms a right angle corner 18 with floor panel portion 19. Said floor panel portion is intended to be horizontally disposed, and terminates in a straight distal edge 27 which is parallel to upper edge 16.

Sidewall portion 15 is provided with axially spaced installation apertures 22, and has a height, defined by the orthogonally measured distance between said upper edge and lower extremity, which is greater than the width of floor panel portion 19, measured between said lower extremity and distal edge.

Second member 20 has the form of an elongated strip of uniform cross-sectional configuration bounded by opposed flat wall surfaces 21 and opposed straight terminal edge surfaces. Said strip has installation apertures 23 spaced apart to align with the apertures 22 of said first member. The width of said strip, measured orthogonally between said terminal edge surfaces, is equal to the height of the sidewall portion 15 of said first member.

The barrier device is installed by placing the first member on one side of a chain link fence with floor panel portion 19 resting upon the ground. The second member is placed upon the opposite side of the fence in facing relationship with the first member and with the respective installation apertures properly aligned. Bolts 24 are then passed through said apertures and preferably through the fence, causing the two members to form a U-shaped structure. The bolts 24 interact with nuts 29 which abut against second member 20 in properly spaced relationship.

The interior region 25 of said U-shaped structure is capable of holding a granular or pelletized composition capable of killing crawling insects. As water is applied through watering or rainfall, said composition enters the ground below the fence. In such manner of use the device of this invention constitutes an insect barrier. Because the U-shaped structure is not water-tight, water will not collect therein which might otherwise destroy the barrier device by freeze-thaw cycles. Because of their simple structural design, the two component members, can be fabricated of reclaimed or reconstituted plastics, thereby further lowering manufacturing cost.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A vegetation barrier adapted to engage the bottom edge of chain link fencing, said barrier comprising:

a) a first member in the form of an extruded L-shaped form of uniform cross-sectional configuration and comprised of an upright sidewall portion elongated along the direction of extrusion and bounded by a straight upper edge and a linear lower extremity that joins in a right angle corner configuration a flat floor panel portion intended to be horizontally disposed, said floor panel portion terminating in a straight distal edge which is parallel to said upper edge, said sidewall portion being provided with axially spaced installation apertures and having a height, defined by the distance between said upper edge and lower extremity, which is greater than the width of said floor panel portion, measured between said linear lower extremity and distal edge, b) a second member in the form of an elongated strip of uniform cross-sectional configuration bounded by opposed flat wall surfaces and opposed straight terminal edge surfaces, said strip having installation apertures spaced apart to align with the apertures of said first member, and having a width, measured orthogonally between said terminal edge surfaces which is equal to the height of the sidewall of said first member, c) threaded bolts which penetrate the aligned apertures of said first and second members, and d) nuts which threadably engage said bolts in abutment with said first an second members, and e) said first and second members being assembled in embracing relationship with the bottom edge of said chain link fence, providing an U-shaped structure defining an interior region adapted to hold a water-leachable composition.

2. The device of claim 1 wherein said interior region is not water-tight, thereby permitting said composition to exit said interior region.

* * * * *